United States Patent [19]

Korger

[11] 3,950,003

[45] Apr. 13, 1976

[54] METHOD AND APPARATUS FOR RELEASING A SKI BOOT FROM A SKI

[75] Inventor: Heinz Korger, Munich, Germany

[73] Assignee: Hannes Marker, Garmisch-Partenkirchen, Germany

[22] Filed: July 31, 1974

[21] Appl. No.: 493,404

[30] Foreign Application Priority Data

Aug. 13, 1974 Germany ..... 2340861

[52] U.S. Cl. ..... 280/11.35 K; 280/11.35 R

[51] Int. Cl.[2] ..... A63C 9/081

[58] Field of Search 280/11.35 R, 11.35 K, 11.35 T, 280/11.35 A, 11.35 D, 11.35 C, 11.35 S

[56] References Cited

UNITED STATES PATENTS

| | | | |
|---|---|---|---|
| 3,731,945 | 5/1973 | Johnson | 280/11.35 T |
| 3,752,491 | 8/1973 | Fend | 280/11.35 K |
| 3,754,770 | 8/1973 | Suhner | 280/11.35 T |
| 3,762,735 | 10/1973 | Smolka | 280/11.35 M |
| 3,772,802 | 11/1973 | Smolka et al. | 280/11.35 D |
| 3,785,664 | 1/1974 | Sittmann | 280/11.35 T |
| 3,892,980 | 7/1975 | Anderson | 280/11.35 M |
| 3,907,316 | 9/1975 | Marker | 280/11.35 M |

*Primary Examiner*—Robert R. Song
*Assistant Examiner*—David M. Mitchell
*Attorney, Agent, or Firm*—Fleit & Jacobson

[57] ABSTRACT

In a method of automatically releasing a ski boot from a ski in case of danger, the force acting on the leg of the skier and the duration of application of said force are ascertained individually and represented as distances, the sum of said distances is compared with a predetermined distance representing a threshold value and, when such threshold value is reached, a connection between the boot and the ski is released. Apparatus for performing this method comprises at least one boot retaining member, a locking device for said retaining member, a threshold value switch acting on said locking device, a duration evaluating member, and a force receiver, the duration evaluating member being provided with a drive motor, such as a plate spring, which is operative when a predetermined minimum force is exerted on the force receiver.

7 Claims, 5 Drawing Figures

METHOD AND APPARATUS FOR RELEASING A SKI BOOT FROM A SKI

The invention relates to an improvement in or modification of the method and apparatus for releasing a ski boot from a ski as disclosed in the pending U.S. patent application Ser. No. 396,723, filed Sept. 13, 1973, entitled "Method and Devices for Releasing a Ski Boot from the Ski", by Hannes Marker et al, which will hereinafter be referred to as the parent patent application.

The parent patent application concerns, inter alia, a method of automatically releasing a ski boot from a ski in case of danger, wherein impulses acting on the leg of the skier are constantly ascertained and compared with a predetermined impulse threshold value, and wherein, when such threshold value has been reached, a connection between the boot and the ski is released. An advantage of this method is that at least one ski boot retaining member need not be moved several millimeters out of its normal position to provide a path which can be used as a damping path or as a measuring size for commanding release of the ski boot. Such movement of a boot retaining member is desirably avoided because it leads to uncontrollable friction between the ski boot, or a sole plate supporting same, and the ski and does not permit accurate setting of the releasing force.

The parent patent application also suggests that the constantly ascertained impulses be referred to a predetermined time interval. According to the parent patent application it is also possible that, referred to a predetermined constant time interval, an arithmetic mean value is continuously formed from consecutive impulses and compared with the threshold value.

The present invention is based on the same underlying concept as is the method according to the parent patent. According to the present invention, the impulse factors, namely the force and the duration thereof, are constantly ascertained individually and represented as distances, these distances being summated and compared with a distance representing the threshold value.

Compared with the prior art, it has been found that hitherto no method was known for associating a predetermined permissible duration with each force exceeding that required to hold the boot on the ski during normal skiing. The paths of the boot retaining member to be measured in accordance with the present method lie within the range of elastic deformation of the material, so that the aforementioned uncontrollable friction will not arise. This makes it possible to dispense with the hitherto essential factor of safety and to increase the upper limit of the retaining force correspondingly, so that such retaining force will be applicable for all skiers, irrespective of their size and weight, whereby individual setting of the binding within wide limits can be dispensed with.

For the purpose of carrying out the method according to the invention, an apparatus is now proposed comprising at least one boot retaining member, a locking device for said retaining member, a threshold value switch acting on said locking device, a duration evaluating member, and a force receiver, wherein the duration evaluating member is provided with a drive motor which is operative when a predetermined minimum force is exerted on the force receiver.

In a preferred form of the invention, the force receiver forms part of the locking device and is mounted on a pivot member which is influenced by a locking latch, the force receiver being coupled to an actuating lever of the threshold value switch, which actuating lever serves to unlock the locking latch and operate the drive motor of the duration evaluating member. The force receiver is preferably in the form of a flexible bar and the drive motor may be in the form of a spring, it being understood that the term 'motor' is being used in its broad sense to mean that which imparts motion. The duration evaluating member is preferably in the form of a member which is pivoted at its centre of gravity and influenced by the drive motor or spring. A particularly simple construction can be achieved if the duration evaluating member is mounted at the free end of the actuating lever.

An example of the method and apparatus according to the invention will now be described with reference to the accompanying drawings, wherein.

Figure 1:
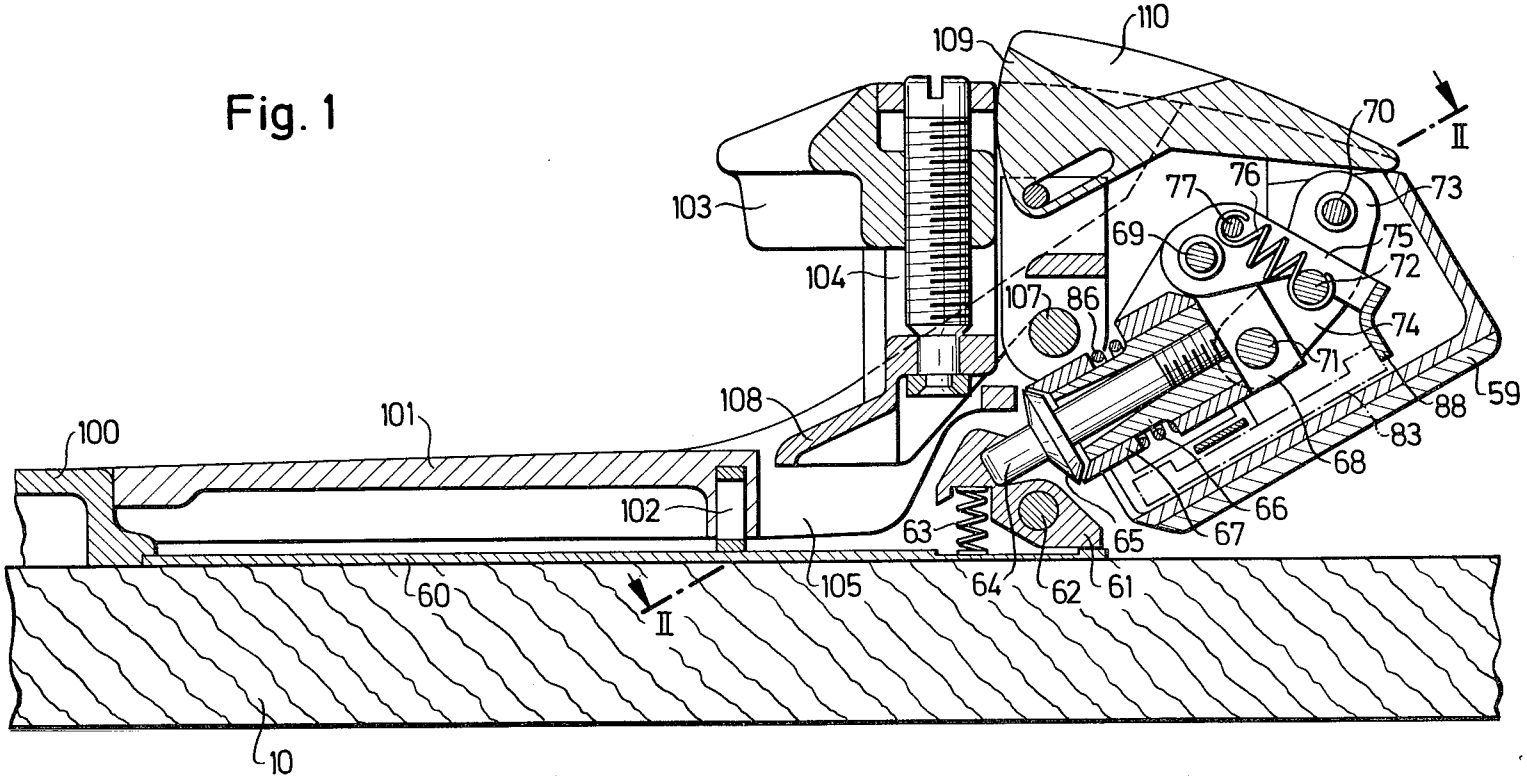
FIG. 1 is a central longitudinal section through that part of a safety ski binding with which the invention is concerned.

The safety ski binding shown in the drawings is a so called plate binding embodying the present invention. Fixed to a ski 10 there is a holding device for a sole plate 101, the holding device including a pivot 100 engaging in a corresponding aperture in the sole plate. The holding device further comprises means (not illustrated) for holding the front of the sole plate down on the ski without impeding rotation of the sole plate about the pivot 100. Yet another component of the holding device is provided near the illustrated back of the sole plate 101 in the form of a part 61 of a locking device which releases the sole plate 101 upon the occurrence of an overload in the vertical and/or horizontal direction. The three components of the holding device for the sole plate are fixed in position relatively to one another on a pre-assembly plate 60. The weight of the skier is transmitted from the sole plate 101 through supporting members 102 onto the ski 10. These supporting members are constructed so that they can withstand tensile and compressive forces exerted normal to the general plane of the ski practically without any deformation but any horizontal forces in the plane of the ski with a relatively large amount of elastic deformation.

A ski boot (not shown) is held down on the sole plate by suitable means (not shown) at the front and by the illustrated holding down means 103 at the back and the boot can be released only intentionally. The sole plate 101, however, can be automatically released from its holding device and hence from the ski 10 upon the occurrence of a force which does not only act suddenly and which exceeds a predetermined amount.

The rear holding down device 103 which is shown in FIG. 1 in a position where it would retain the boot and which is adjustable so that it can be adapted to soles of various thicknesses, is fixed to a supporting member 104 which is pivotally mounted on a horizontal shaft 107 that extends transversely to the length of the plate 101 and is carried by rear side wings 105, 106 of the plate 101. At its lower end, as viewed in FIG. 1, the supporting member 104 is provided with a closing pedal 108 beneath the level of the holding down means 103 for the sole. An unlocking device 109 having a cavity 110 for the insertion of the tip of a ski stick is effective to lock the supporting member 104 to the holding down means 103 in the position as illustrated in FIG. 1. If the unlocking device 109 is depressed, it causes the supporting member 104 and holding down means 103 to swing to the right as viewed in FIG. 1 so as to permit rearward movement of the ski boot and disengagement of the holding down means 103 from the sole of the ski boot. A similar type of interlocking device 109 is shown in the copending application entitled "Safety Ski Binding", Ser. No. 444,371, filed by the applicant herein on Feb. 24, 1974. Automatic fixing of the sole of the boot on the sole plate 101 is effected when the heel of the boot is depressed and the supporting member 104 pivoted through the pedal 108.

The aforementioned part 61 of the releasable locking device for the sole plate is part of the locking device and is mounted on a transverse horizontal pivot 62 fixed to the ski and is under the influence of a compression spring 63 which urges it to its upper limiting position. The other part of the locking device is formed by the free end of a flexible bar 64 which is fixed in a sleeve 66, for example by screw-threaded engagement therewith. The sleeve 66 is mounted in a pivot member 68 suspended from a transverse pivot 69. The latter is mounted in side walls of a housing 59 with which the side wings 105, 106 of the sole plate 101 merge (see FIG. 2). The pivot member 68 carries a pivot pin 71 parallel to the pivot 69. One arm 74 of a bell crank lever is mounted on this pivot pin 71. The other arm of the bell crank lever is indicated at 73 and its pivot at 72. The arm 73 is mounted on a pivot pin 70 which is also parallel to the pivot 69 and held in side walls of the housing 59.

Received in a central recess of the pivot member 68 and mounted on the pivot 69 there is a locking latch 75. This latch is substantially U-shaped and suspended from the free ends of the limbs of the U. In the vicinity of the web of the U, the limbs are recessed so that they will normally adequately embrace the pivot 72 of the bell crank lever and thereby prevent displacement of this pivot to the right-hand side as viewed in FIG. 1. At the same time, this prevents pivoting of the pivot member 68 about the pivot 69 (again to the right as viewed in FIG. 1) and thus normally prevents release of the locking device 61, 64.

Figure 2:
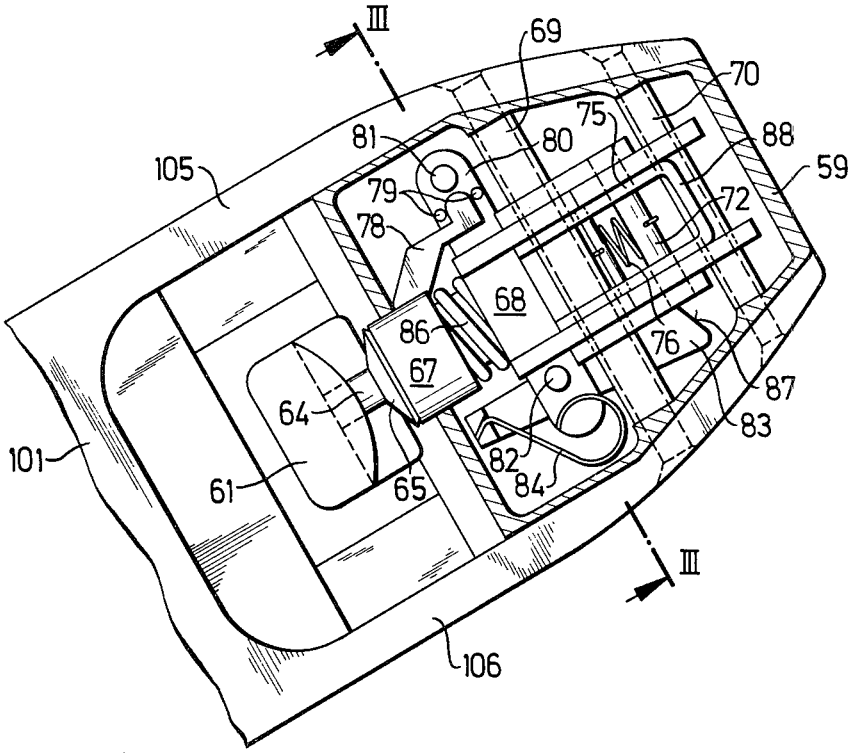
FIG. 2 is a section on the line II—II in FIG. 1.
Figure 3:
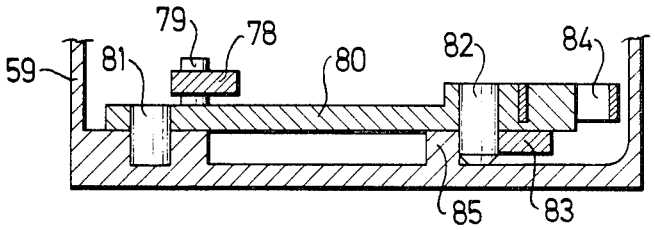
FIG. 3 is a section on the line III—III in FIG. 2.

The flexible bar 64 is provided with a collar 65 which extends right up to the end of a ring 67 that is axially displaceable on the sleeve 66. Displacement of the ring 67 takes place against the force of a resetting spring 86 which is supported by the pivot member 68. Fixed to the ring 67 there is a carrier 78 which, as shown in FIG. 2, has an oblique nose engaging between two pins 79. These two pins are provided on an actuating lever 80 in the vicinity of the pivot pin 81 thereof. The pivot pin 81 of the lever 80 is mounted in a hole in the lower wall of the housing 59, as shown in FIG. 3. In the vicinity of its free end, the actuating lever 80 carries a pivot pin 82 on which a pivot member 83 is mounted at its centre of gravity. This pivot member is under the influence of a curved plate spring 84 of which one end is mounted in the actuating lever 80. The pivot member 83 and spring 84 together form a duration evaluating member in accordance with the present invention. In the normal position of the actuating lever 80 (see FIG. 4) the pivot member 83 is in contact with an abutment 85 of the housing 59 under the influence of the spring 84.

Figure 4:
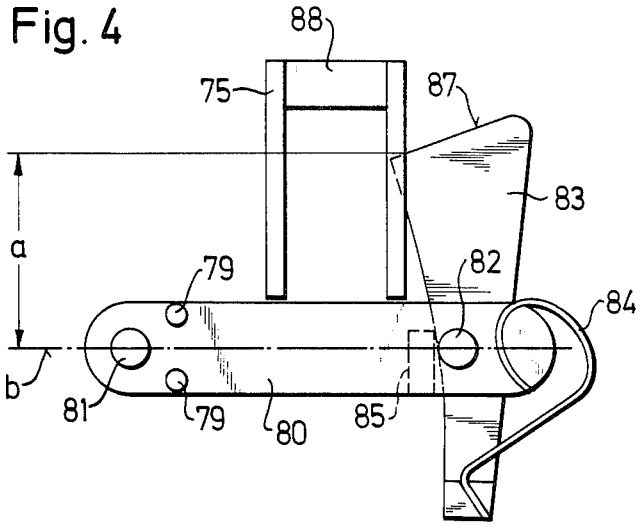
FIG. 4 is a plan view of the part shown in FIG. 3 but the housing of FIG. 3 being omitted.

In conjunction with the pivot member 83 and locking latch 75, the actuating lever 80 forms the threshold value switch according to the invention. Referring to FIG. 4, the pivot member 83 has its free end at the left-hand side extended up to the web 88 of the latch 75 (also see FIG. 1). In FIG. 4, the distance *a* represents the normal spacing between the free end of the pivot member 83 and a straight reference line *b* which passes through the pivot pins 81 and 82 when the actuating lever assumes its normal position. The distance to the pivot point increases from the top left-hand side to the top right-hand side of the pivot member 83 in FIG. 4, i.e. the end of the pivot member is oblique as indicated at 87, and this oblique end serves as a variable abutment against the web 88 of the latch 75, in a manner to be described hereinafter. A returning and holding spring 76 for the latch 75 is supported by the pivot 72 of the bell crank lever and a pin 77 on the latch 75.

The cross-section of the flexible bar 64 is dimensioned so that loads arising out of normal skiing lie within the range of elastic bending of the bar. In order to permit such movement of the bar, the internal diameter of the sleeve 66 increases outwardly. The section moduli of the bar 64 are adapted to the most varied forces in the various directions of loading.

If a force is applied to the sole plate 101 that exceeds the retaining force, whether this be transversely to the length of the ski or upwardly at the rear holding down means 103 or even diagonally, this will result in elastic bending of the bar 64, causing the collar 65 of the latter to displace the sleeve 66 against the force of the resetting spring 86. This displacement gives rise to pivoting of the actuating lever 80 because the ring 67 is operatively connected to the actuating lever through the carrier 78 and pins 79. By reason of the lever advantage, the pivot pin 82 carrying the pivot member 83 executes a correspondingly larger pivotal displacement, as will be evident from FIG. 5.

Figure 5:
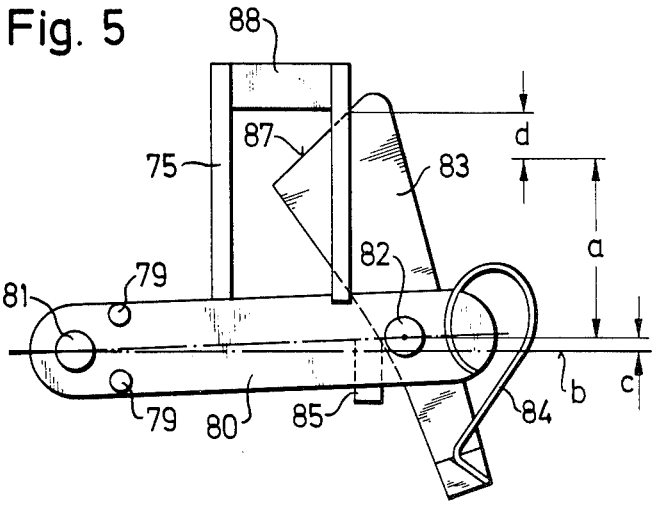
FIG. 5 is a plan view corresponding to FIG. 4 but showing the actuating lever and duration evaluating member in different instantaneous positions.

As soon as the actuating lever 80 has been pivoted to a sufficient extent, the pivot member 83 is freed from its abutment 85 and can swing, for example, to the position illustrated in FIG. 5 under the influence of the spring 84. The abutment 85 is so dimensioned that the pivot member 83 will swing only when the seemingly static actuating force has been reached. Upon occurrence of a correspondingly high force, the oblique end face 87 of the pivot member 83, which normally is disposed in spaced relationship with the latch web as shown in FIG. 4, will then come to lie against the web 88 of the latch 75 and it will assume a position depending on the duration of such force. An impulse released by the pivot member 83 against the latch 75 will then cause the pivot 72 of the bell crank lever to be released, whereby the latter will be turned suddenly to release the locking device 61, 64 and thereby free the sole plate 101 from the ski 10. If a force of relatively short duration and low magnitude is applied to the leg of the skier, such as would be encountered during normal skiing activity, the actuating lever 80 is pivoted as before moving the pivot member 83 upwardly as viewed in FIG. 4. However, the period of application of the force would be too short to permit the spring 84 to pivot the pivot member 83 to the left as seen in FIG. 5 for engagement of the oblique face 87 with the latch web 88 so no unlocking occurs. On the other hand, a force of high magnitude, even though of short duration, could move the pivot member 83 to the extent that engagement and release could occur with virtually no pivotal movement of the pivot member 83.

The sole plate may be loosely connected to the ski by a cable or the like so that it will not be flung away from the skier. Attachment to the ski is effected simply by placing the sole plate 101 on the pivot 100 and then locking the parts 61 and 64. This will cause the free end of the flexible bar 64 to lie against the part 61 which can swing downwardly against the force of the compression spring 63 and then snap back to hold the flexible bar as soon as the normal position of the sole plate has been reached on the ski. After release of the bar from the part 61 of the locking device, the bell crank lever and hence the pivot member are momentarily fixed again because the spring 76 pulls the bell crank lever back and allows the latch to snap into engagement.

This construction permits the underlying concept of the invention to be achieved, namely to ascertain the impulse factors (force acting on the leg of the skier and the duration of said force) individually and to represent their sizes as distances. In FIG. 5 these distances are shown for one particular case. The distance resulting from the applied force is designated *c* whilst the distance resulting from the duration of the force is designated *d*. The sum of these two distances is just sufficiently large to reach the threshold value, resulting in momentary spontaneous release in that the pivot 72 of the bell crank lever is freed by the locking latch 75. The distance *a* shown in FIG. 5 is fixed and is governed by the construction of the apparatus.

If the sum of the two distances representing the force and its duration is less than the distance representing the threshold value, the spring 86 will press on the sleeve 67 after the force has abated and will therefore also press the lever 80 back to its normal position. The pivot member 83 will, against the force of the spring 84, be pulled back to its locking position against the abutment 85 by return of the actuating lever 80.

As has been explained, the threshold value may be described as that value above which release of locking device 61 will occur and represents a combination of the applied force and the duration of such force which permits engagement between the oblique face 87 of member 83 and the latch web 88 to an extent sufficient to effect release of locking latch 75.

Since the pivot member 83 is suspended at its centre of gravity, accelerating influences which might lead to falsification of the influences represented by the duration of the force are eliminated. If impacts are exerted on the locking device, they effect rapid pivoting of the actuating lever 80, thereby giving insufficient time to the pivot member 83 to turn so far that it might strike the web 88 of the latch 75. False actuation is therefore not possible.

The duration evaluating member ascertains durations at least in the centisecond range. The apparatus of the invention is not restricted to a spring for use as the duration evaluating member. All that is necessary is a mechanical drive force.

I claim:

1. An apparatus for automatically releasing a ski boot and sole plate therefor from a ski upon the application of an excessive, prolonged force on the leg of a skier, comprising, in combination, a sole plate for accommodating a ski boot, means for releasably locking said sole plate on the ski in a fixed position, said locking means including a flexible force responsive member supported on said sole plate and engageable with said ski, latching means on said sole plate for permitting disengagement of said force responsive member from said ski, means including said force responsive member for sensing the magnitude of force applied to the leg of a skier in terms of, means for mechanically sensing the duration of said applied force, means for mechanically applying the sensed values of both said sensing means to said latching means to permit disengagement of said force responsive member when the combined values of both of said sensing means exceeds a threshold value to release said locking means and said sole plate from the ski.

2. Apparatus in accordance with claim 1 wherein said locking means includes a detent member pivotally mounted on the ski, a pivot member supported on said sole plate, said flexible force responsive member supported on said pivot member and engageable with said detent member for releasably locking said sole plate to the ski, and wherein said latching means includes a latch member pivotally mounted on said sole plate engageable with said pivot member for retaining said force responsive member and said detent member in locking engagement, and wherein said force sensing means and duration sensing means include an actuating lever having a free end pivotally mounted on said sole plate and connected to said force responsive member, a duration evaluating member pivotally mounted on said actuating lever, stop means on said sole plate for limiting the pivotal movement of said duration evaluating member and wherein said duration evaluating member includes means for urging said duration evaluating member against said stop means in sliding engagement therewith, said duration evaluating member being movable by said actuating lever into engagement with said latch member to release said pivot member for pivotal movement of said pivot member and disengagement of said force responsive member from said detent member.

3. Apparatus in accordance with claim 1, wherein said locking means includes a pivot member supported on said sole plate, a detent member pivotally mounted on the ski and wherein said force responsive member comprises a flexible bar supported at one end on said pivot member and having the other end engageable with said detent member.

4. Apparatus in accordance with claim 2, wherein said duration evaluating member comprises a pivot member and wherein said urging means comprises a spring connected to one end to said actuating lever and at the other end to said pivot member of said duration evaluating member.

5. Apparatus in accordance with claim 4, wherein said pivot member of said duration evaluating member is pivotally mounted on said actuating lever at its center of gravity.

6. Apparatus in accordance with claim 5, wherein said pivot member of said duration evaluating member is pivotally mounted on the free end of said actuating lever.

7. A method of automatically releasing a ski boot from a ski on which the ski boot is mounted upon the application of an excessive, prolonged force on the leg of the skier comprising the steps of:

providing a releasable locking device including a flexible force responsive member and a pivotal duration evaluating member, mounting said releasable locking device on a ski such that said force responsive member is engaged between the ski and the ski boot, releasably locking the ski boot to the ski in a fixed position with said locking device, sensing the flexual movement of said force responsive member representative of the magnitude of the force applied to the leg of the skier, mechanically sensing the extent of movement of said duration evaluating member representative of the duration of the force applied to the leg of the skier simultaneously with and independently of said flexural movement sensing step, combining the movements sensed during said force magnitude and duration sensing steps to provide a total sensed movement, and transmitting said total sensed movement to permit the disengagement of said flexible force responsive member in said locking device when a predetermined total sensed movement is reached to unlock said locking device and release the boot from the ski.

* * * * *

UNITED STATES PATENT AND TRADEMARK OFFICE

CERTIFICATE OF CORRECTION

PATENT NO. : 3,950,003

DATED : April 13, 1976

INVENTOR(S) : Heinz KORGER

It is certified that error appears in the above-identified patent and that said Letters Patent are hereby corrected as shown below:

Column 6, line 9, after "of", insert --the movement caused by the flexure of said force responsive member--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*